United States Patent [19]

Drucker et al.

[11] Patent Number: 4,565,075

[45] Date of Patent: Jan. 21, 1986

[54] POLYGON FAN COIL CABINET AND METHOD OF ASSEMBLY

[75] Inventors: Alan S. Drucker, Dewitt; King H. Kwok, Liverpool; Charles E. Whipple, Brewerton, all of N.Y.

[73] Assignee: Carrier Corporation, Syracuse, N.Y.

[21] Appl. No.: 618,657

[22] Filed: Jun. 8, 1984

[51] Int. Cl.[4] ..... F25B 39/04

[52] U.S. Cl. ..... 62/507; 165/122; 415/219 R; 417/424

[58] Field of Search ..... 165/76, 122; 415/121 A, 415/219 R; 417/360, 424; 62/516, 77, 298, 507, 285

[56] References Cited

U.S. PATENT DOCUMENTS

| | | | |
|---|---|---|---|
| 4,043,708 | 8/1977 | Greenfield | 62/507 |
| 4,261,418 | 4/1981 | Helt et al. | 62/298 |
| 4,394,111 | 7/1983 | Wiese et al. | 165/122 |
| 4,416,327 | 11/1983 | Nakada et al. | 62/285 |

*Primary Examiner*—Ronald C. Capossela

*Attorney, Agent, or Firm*—Dana F. Bigelow

[57] ABSTRACT

An indoor fan coil unit of a split type air conditioning or heat pump system. This indoor unit has a non-metallic polygon shaped casing with duct connections extending through each side. A cylindrical heat exchanger is mounted within the casing and a blower is mounted through an opening in the top of the casing within the heat exchanger. The blower draws air through the top of the casing and directs the air through the heat exchanger and out each duct connection to the ducts connected to each space to be conditioned.

10 Claims, 8 Drawing Figures

POLYGON FAN COIL CABINET AND METHOD OF ASSEMBLY

BACKGROUND OF THE INVENTION

The present invention relates generally to cabinets for a fan coil unit for use in heating and cooling, and, more particularly, to an improved polygon cabinet consisting of a number of identical side pieces with an interlocking mechanism, a bottom pan, and a top pan and a method of assembling the cabinet and fan coil unit.

A typical split air conditioning system, which might be a heat pump, includes an outdoor heat exchange unit having an outdoor heat exchanger, compressor, controls and a reversing valve, and an indoor unit. The indoor unit includes an indoor heat exchanger, supplemental heaters when using a heat pump, and a fan for circulating indoor air to be conditioned in heat exchange relation with the indoor heat exchanger. The indoor unit is connected by two refrigerant lines to the outdoor unit and is generally located within the space to be conditioned. Typically, in a cooling mode of operation, the liquid refrigerant is evaporated in the indoor heat exchanger absorbing its heat of vaporization from the air to be cooled, while in the heating mode of operation, the gaseous refrigerant is condensed to heat the indoor air by discharging its heat of condensation to the air being circulated in heat exchange relation with the heat exchanger. Accordingly, supplemental heaters, generally spaced between the coil and the cabinet, may be needed when using a heat pump.

The indoor heat exchanger is typically arranged to allow the fan to draw return air from the enclosure to be conditioned to the indoor unit and for the same fan to circulate air through the heat exchanger for conditioning the air and then back to the space to be conditioned. The indoor heat exchanger is typically operated under the control of the thermostat located in the space to be conditioned. The thermostat acts to control both the refrigeration circuit and the fan.

The present indoor unit cabinet is designed in a specific configuration to effectively utilize a cylindrical heat exchanger and to provide a compact unit having spaced peripheral duct openings about the circumference such that numerous ducts may be connected to the indoor unit for supplying conditioned air to the appropriate spaces within the enclosure. Additionally, a centrifugal fan is mounted on the cabinet and projects into the control space of the cylindrical heat exchanger. The fan is operated without utilizing a fan scroll such that return air is drawn inwardly into the fan along the central axis thereof and is discharged outwardly through the heat exchanger to the duct openings and then through the ducts. By utilizing a cylindrical heat exchanger and a polygon cabinet the air is evenly distributed through the entire heat exchanger and is thereafter evenly distributed to the individual ducts of each space to be conditioned.

The disclosed cabinet construction provides for a reduced physical volume (up to 50% less than conventional fan coil units), and provides variable supply air outlets for zoning purposes depending on the requirements. Additionally, by providing duct outlets spaced about the cabinet rather than a large single plenum discharge, low installation costs are promoted since each duct may be simply connected to a duct outlet.

SUMMARY OF THE INVENTION

The present invention is directed to an improved cabinet for an indoor fan coil and a method for assembling said fan coil unit.

In a preferred embodiment, the polygon cabinet consists of a number of identical double-wall side pieces, with tongue and groove interlocking mechanisms for providing air tight joints and thus avoiding sealing materials, and a top piece and a bottom piece. The top and bottom pieces of the polygon cabinet have a generally U-shaped channel around the perimeter thereof, for supporting the side pieces in a vertical plane along the longitudinal axis of the unit. Accordingly, assembly labor is minimized and the design becomes very cost effective because no adhesives and a minimum number of fasteners are used in assembling the cabinet. In addition, the symmetry of the design allows for automatic (robotic) assembly of the cabinet, and thus further reduces labor costs.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
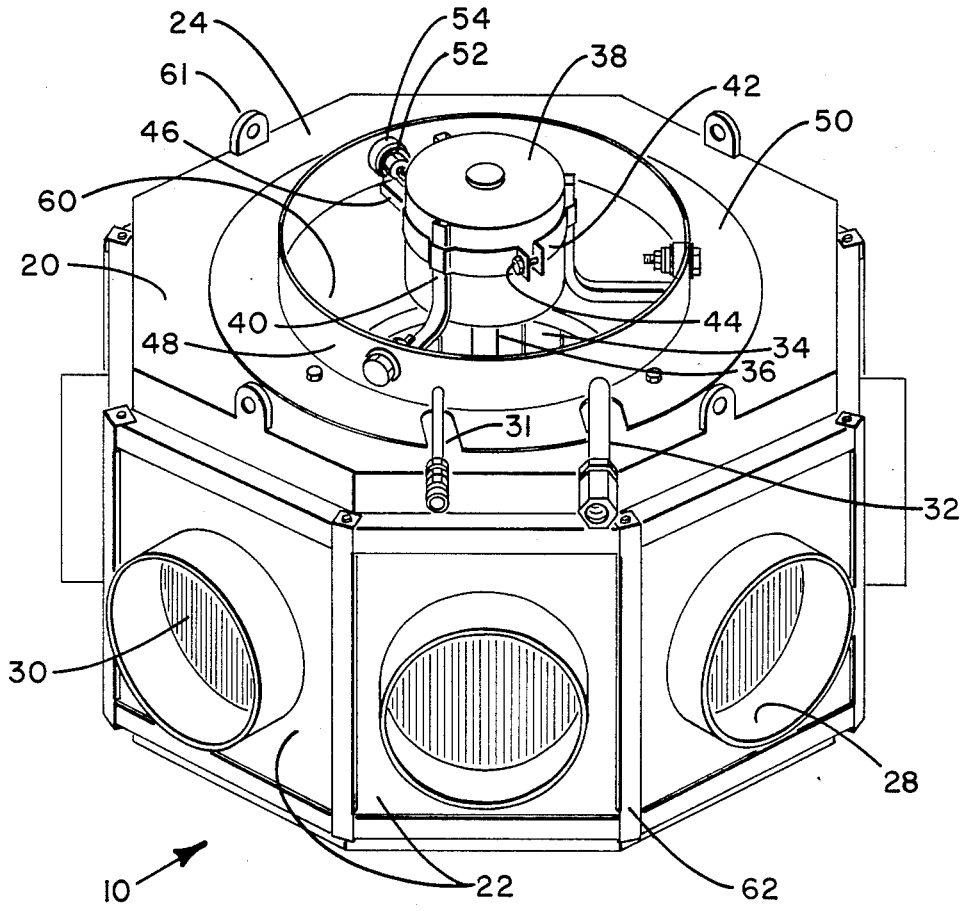
FIG. 1 is a perspective view of an indoor fan coil unit.
Figure 2:
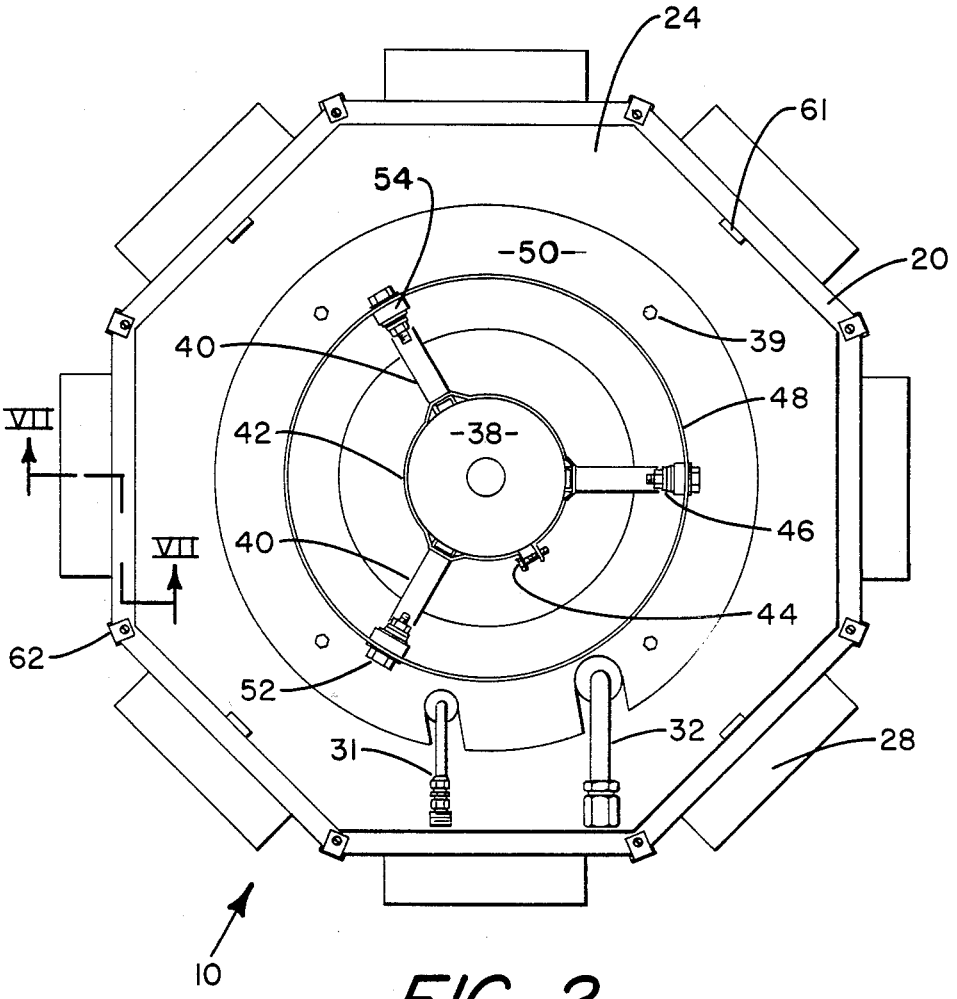
FIG. 2 is a top plan view of the indoor fan coil unit of FIG. 1.
Figure 3:
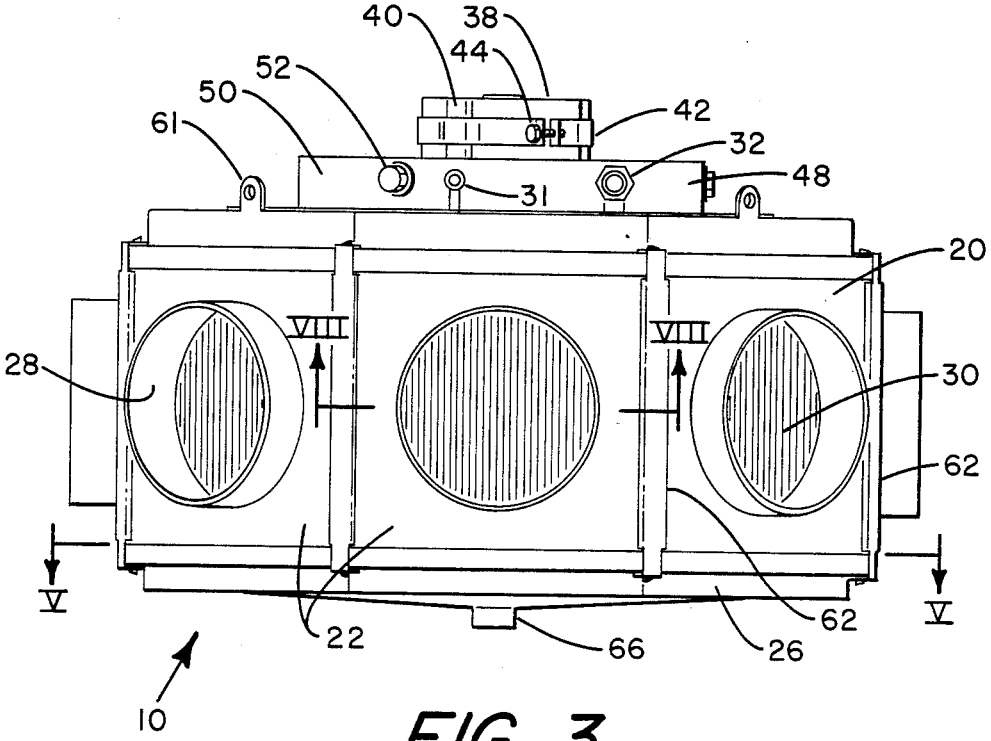
FIG. 3 is an elevation view of the indoor fan coil unit of FIG. 1.
Figure 4:
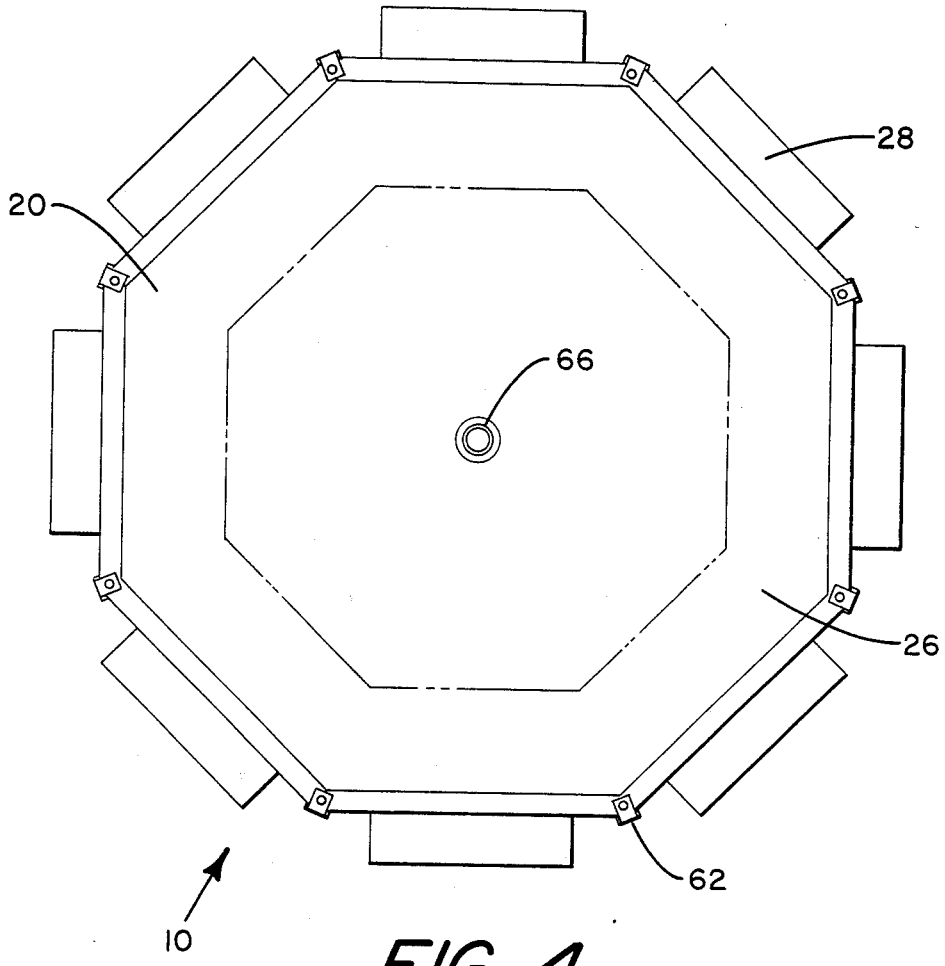
FIG. 4 is a bottom plan view of the indoor fan coil unit of FIG. 1.

Referring to FIGS. 1–4, there is illustrated an indoor fan coil unit 10 for use with a split type air conditioning system. It is to be understood that this fan coil unit may be mounted anywhere within the structure to be conditioned, although preferably mounted in an attic.

Typically, an outdoor unit (not shown) is mounted on a pad or some other exterior mounting structure in communication with outdoor ambient air. In a straight cooling unit the outdoor unit would include both a condenser and a compressor. If the outdoor unit is a portion of a heat pump the outdoor unit would additionally include a four-way valve and the condenser would be the outdoor heat exchanger capable of being either the condenser or the evaporator depending on the mode of operation of the system.

It can be seen, in FIGS. 1–4, that cabinet 20 is generally octagonal. However, it is to be understood that the cabinet may have any number of sides, e.g. three, six, nine, etc., depending upon the number of outlets and spaces to be conditioned (e.g. a two ton unit could have six sides, while a five ton unit could have eight sides or more). The cabinet 20, as shown and described, includes eight identical side pieces 22 forming the vertical portion of the cabinet. It additionally includes top portion 24 and bottom portion 26. Extending from each cabinet side piece 22 are duct outlet flanges 28. It is to these duct outlet flanges 28 that the ducts (not shown) are connected which direct supply air, which has been heated or cooled within the indoor unit, to the space to be conditioned.

Located within cabinet 20 is a heat exchanger 30. Heat exchanger 30 is formed from a plurality of runs of heat exchange tubing wound in a generally cylindrical configuration. Refrigerant connections 31, 32 are for connecting refrigerant lines from the outdoor unit to the indoor fan coil unit. It is also understood that the heat exchangers may be of a plate fin heat exchanger, wound fin type, or any other type capable of being manufactured in the shape of a hollow cylinder.

Blower wheel 34 which may be a backward inclined centrifugal fan is shown mounted on one end of blower shaft 36 which is connected to blower motor 38 at the opposite end. Fan motor 38 has a bracket or belly band 42 extending thereabout which is secured together by fastener 44. Additionally, secured between the fan motor 38 and the motor bracket 42 are motor mount legs 40 which extend radially outwardly therefrom. Motor mount legs 40 include axial flange 46 which coacts with portion 48 of duct connector 50. Fasteners 52 are shown for securing the flanges 46 of the motor mount legs 40 to the portion 48 of the duct connector 50 through grommet 54, thus securing the blower wheel 34 and fan motor 38 in position as shown.

Orifice 60 is shown for allowing air flow to enter through the top of the unit downwardly into the unit in the axial direction of the fan motor 38 and heat exchanger 30. The blower wheel 34 then accelerates this air and discharges it outwardly through the heat exchanger 30 to the duct outlet flanges 38. Electric resistance heaters 64 are shown (FIG. 6) between the heat exchanger and the cabinet for supplying heat energy to the air when a heat pump is used. These heaters may be hot water or other types of heaters rather than electrical resistance heaters.

Figure 5:
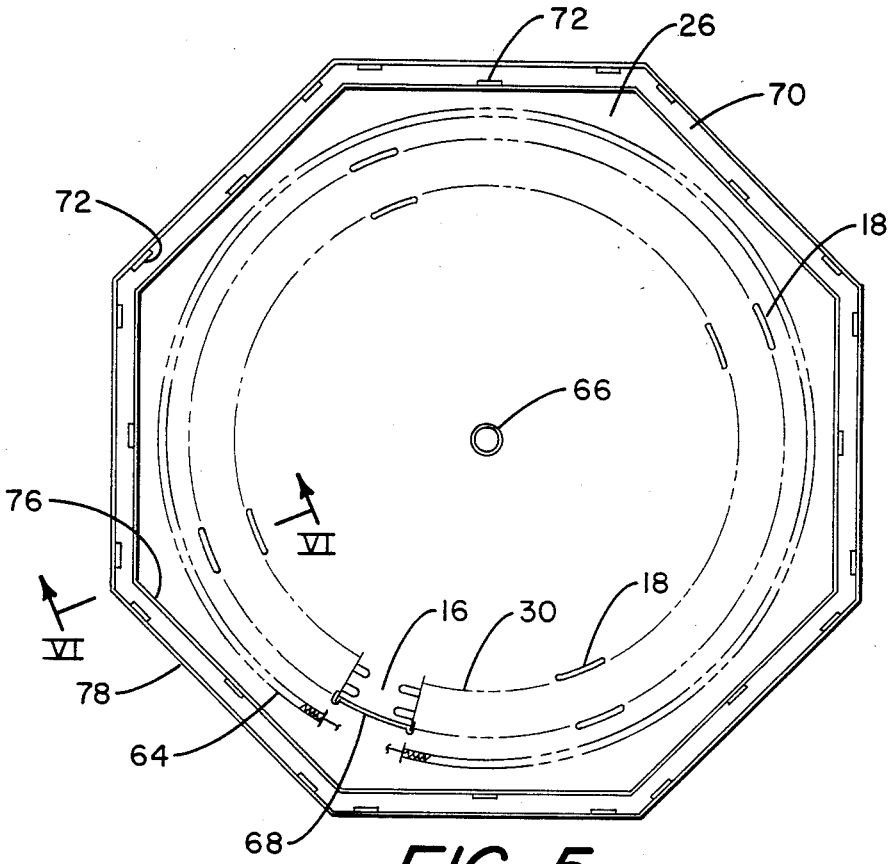
FIG. 5 is a cross-sectional view taken along lines 5—5 of FIG. 3.

FIG. 5 shows bottom portion 26 which extends across the entire bottom of the unit and serves to prevent air from flowing into the blower through the bottom of the unit. Also shown is primary drain 66 extending from the center of bottom portion 26. The primary drain is used for collecting and disposing of condensate dripping from the heat exchanger, when it serves as an evaporator. The bottom portion is generally concave to permit the condensate to flow by gravity through the primary drain 66 to a disposal area. Secondary drains may be placed around the perimeter of the bottom portion to provide a backup drain opening should the primary drain fail to function, or may be used as primary drains if the bottom portion 26 is either flat or convex.

FIG. 5 is a plan view of the bottom portion 26 showing the respective relationship between the heat exchanger 30, the electric resistance heaters 64 (both shown in phantom), and the sides of the cabinet 20 which sit in the U-shaped channel 20. Further, mounted to the heat exchanger 30 in the gap 16 is an air baffle 68 which prevents air from short circuiting the heat exchanger 30, thus forcing the air to flow through the heat exchanger. The air baffle 68 may be a piece of sheet metal which is removably fastened to the ends of the heat exchanger. Since the heat exchanger extends entirely about the fan, the air flow is directed evenly across the entire heat exchanger. The same air flow, after it is directed evenly through the heat exchanger, is then supplied evenly to each of the duct outlet flanges 28. Hence, an equal amount of air flow may be provided to each duct using the arrangement as shown. This arrangement allows for smooth, even air flow and a reduced energy requirement for the fan motor to direct a given amount of air flow through the heat exchanger to the space to be conditioned.

Figure 6:
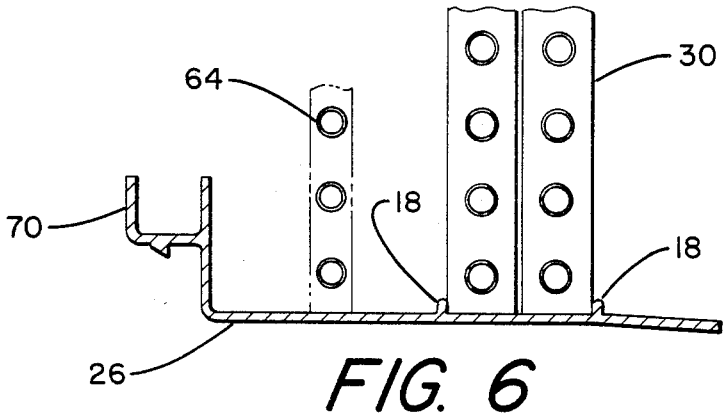
FIG. 6 is an enlarged cross-sectional view taken along line 6—6 of FIG. 5.

As may be most readily seen in FIG. 6, the heat exchanger 30 is held in position on the bottom portion 26 of the cabinet by protrusions 18. These protrusions insure that the heat exchanger 36 is mounted coaxially with the blower wheel 34.

Figure 7:
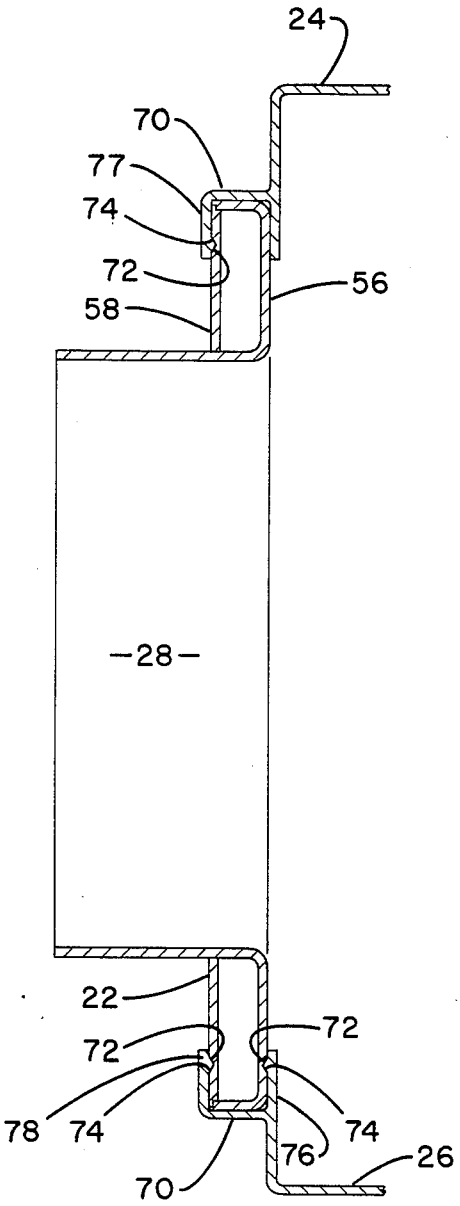
FIG. 7 is an enlarged cross-sectional elevational view of the side of the present invention taken along line 7—7 of FIG. 2.
Figure 8:
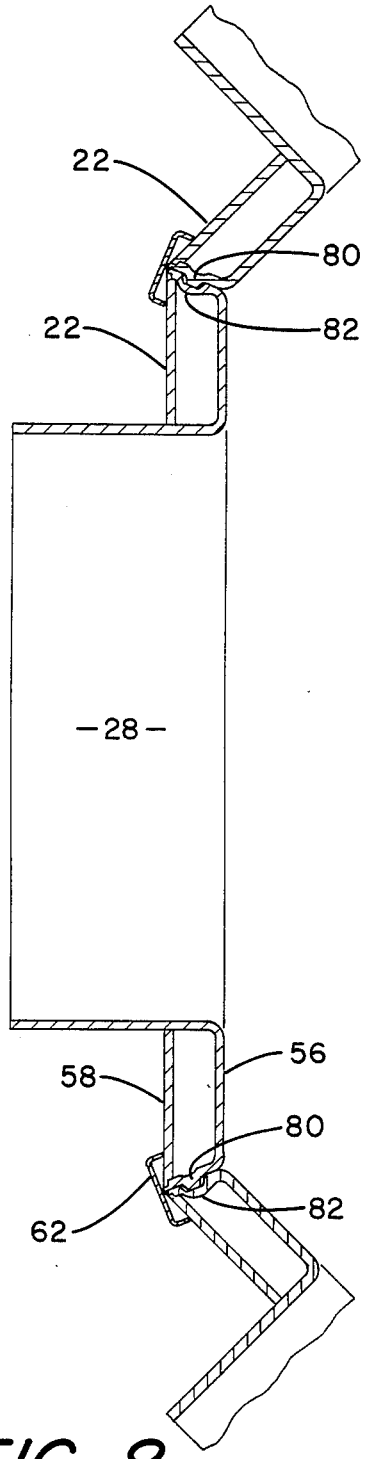
FIG. 8 is an enlarged cross-sectional plan view of the side of the present invention taken along line 8—8 of FIG. 3.

As best shown in FIGS. 7 and 8 the side pieces 22 have a double-wall construction. An inside wall 56 and an outside wall 58 form an insulated side piece 22 which prevents condensate from forming on the outer portion of the cabinet, such as would occur if the side walls were single-wall construction. Further, the side pieces 22 are secured in generally U-shaped channels 70 by the protrusions 72 in the top and bottom portions 26, 24 mating with the indentations 74 in the side pieces 22. Generally, the U-shaped channels 70 of the bottom portion 26 contain protrusions 72 on both the inner leg 76 and outer leg 78, while the top portion 24 contains protrusions 72 only on the outer leg 77. The single protrusion 72 on the top outer leg is provided in order that maintenance personnel may easily remove the top portion 24 during repairs.

FIG. 8 clearly shows the tongue 80 and groove 82 interlocking mechanisms for securing the side pieces 22 together in an air tight relation. The top and bottom portions 24, 26 are held in a secure position with respect to the side pieces 22 by a retainer 62. The retainer 62 may be omitted, but is generally used, particularly when the indoor fan coil unit 10 is suspended from the overhead by use of cables connected to lugs 61.

The method of assembling the fan coil unit may now be clearly understood. The bottom portion 26 is initially supported in a base pad or jig and the heat exchanger 30 with its air baffle 68 is then placed therein, within the protrusions or circular ribs 18. Individual side pieces 22 are then mated together in the U-shaped channel 70 of the bottom portion by means of the tongue and groove interlocking mechanisms. When all of the sides have been interlocked together, the top portion 24 is placed on the side pieces so that the U-shaped channel 70 of the top portion fit over a portion of the side pieces. Finally, the orifice 60, the duct connector 50, and the blower wheel and motor are secured to the top portion 24 by fasteners 39. Additionally, retainers 62 may then be secured to the top and bottom portions 24, 26 to ensure the cabinet's integrity.

As noted, the fan coil unit may be assembled easily and with a minimum number of fasteners, thereby reducing the cost of assembling the unit.

It has been found that the top portion 24, bottom portion 26, side pieces 22, and orifice 60 perform satisfactorily when they are molded from Acrylonitrile-Butadiene-Styrene material manufactured by Borg-Warner.

What is claimed is:

1. An apparatus for enclosing and supporting an indoor fan coil having a generally cylindrical heat exchanger with a blower located within the cylindrical heat exchanger, the apparatus comprising:

a fan coil supporting member having a bottom wall defined by a surface with at least one condensate drain outlet for allowing condensate to drain from said supporting member;

a plurality of side members removably secured at one end to said fan coil supporting member and having an inner peripheral surface spaced from the outer vertical surface of the cylindrical heat exchanger, at least one of said side members having an aperture therethrough defining an outlet opening;

a top member removably secured to the other end of said side member to form an enclosure for the indoor fan coil, said top member having an aperture therethrough concentric with the cylindrical heat exchanger through which to draw air into the enclosure by way of the blower and to discharge said air outwardly through the cylindrical heat exchanger to said outlet openings.

2. The apparatus as set forth in claim 1 wherein said bottom wall of said supporting member is defined by a concave surface.

3. The apparatus as set forth in claim 1 wherein said fan coil supporting member and said top member further include a generally U-shaped channel for removably securing said side members therein.

4. The apparatus as set forth in claim 3 wherein said generally U-shaped channels further include a plurality of protrusion means extending from the legs of said U-shaped channels and said side members each include a corresponding indentation means into which said protrusion means may be removably secured.

5. The apparatus as set forth in claim 1 wherein said side members include an inner wall means spaced apart from an outer wall means defining an enclosed air space for insulating said side members to prevent condensation from forming on said outer wall means.

6. The apparatus as set forth in claim 5 wherein said inner and outer walls are composed of Acrylonitrile-Butadiene-Styrene.

7. The apparatus as set forth in claim 1 further comprising an orifice means secured to said top member in said aperture in a concentric relation with the cylindrical heat exchanger through which the air is drawn into the enclosure.

8. In a cabinet for an indoor fan coil unit of the type having a generally cylindrical heat exchanger with a fan located interiorly of the heat exchanger, the improvement which comprises:

a base member having a generally concave bottom wall and a side wall, defining a polygon shape, extending generally perpendicular to said bottom wall, said side wall having a generally U-shaped channel extending from the end thereof;

a plurality of said side members each secured at one transverse end within said U-shaped channel of said base member, at least one of said side members having an aperture therethrough defining an air outlet opening;

a top member having a generally flat top wall and a side wall, defining a polygon shape, extending generally perpendicular to said top wall, said side wall having a generally U-shaped channel extending from the end thereof for securing the other transverse end of said side members therein, said top member having an aperture therethrough concentric with the cylindrical heat exchanger; and an orifice means secured to said top member and concentric with said aperture therein and the cylindrical heat exchanger for locating the fan concentric with the cylindrical heat exchanger to allow the fan to draw air into the cabinet and to discharge the air outwardly through the heat exchanger to said air outlet opening.

9. The cabinet as set forth in claim 8 wherein said side members comprise an inner wall means spaced apart from an outer wall means defining an enclosed air space for insulating said side members to prevent condensation from forming on said outer wall means.

10. The cabinet as set forth in claim 9 wherein said side members are composed of Acrylonitrile-Butadiene-Styrene.

* * * * *